US009593506B2

(12) United States Patent
Lockwood et al.

(10) Patent No.: US 9,593,506 B2
(45) Date of Patent: Mar. 14, 2017

(54) METHOD OF MODULAR POLE CONSTRUCTION AND MODULAR POLE ASSEMBLY

(75) Inventors: Phil Lockwood, Calgary (CA); David Chambers, London (GB)

(73) Assignee: RS Technologies Inc., Calgary, Alberta (CA)

( * ) Notice: Subject to any disclaimer, the term of this patent is extended or adjusted under 35 U.S.C. 154(b) by 1432 days.

(21) Appl. No.: 11/815,754

(22) PCT Filed: Feb. 7, 2006

(86) PCT No.: PCT/CA2006/000155

§ 371 (c)(1),
(2), (4) Date: Mar. 19, 2008

(87) PCT Pub. No.: WO2006/081679

PCT Pub. Date: Aug. 10, 2006

(65) Prior Publication Data

US 2009/0019816 A1 Jan. 22, 2009

(51) Int. Cl.
*E04H 12/18* (2006.01)
*E04H 12/34* (2006.01)
(Continued)

(52) U.S. Cl.
CPC ..... *E04H 12/34* (2013.01); *E04H 12/02* (2013.01); *E04H 12/08* (2013.01); *Y10T 29/49826* (2015.01); *Y10T 428/1393* (2015.01)

(58) Field of Classification Search
USPC .... 52/848, 745.17, 745.18, 223.5, 834, 835, 52/301; 156/173, 293, 294; 428/36.3
See application file for complete search history.

(56) References Cited

U.S. PATENT DOCUMENTS 232,360 A * 9/1880 Milliken ..... 52/848
295,905 A * 4/1884 Brott ..... 52/834
(Continued)

FOREIGN PATENT DOCUMENTS

CA 2274328 12/2000
CA 2444324 4/2005
(Continued)

OTHER PUBLICATIONS

Performance Evaluation of Fiber-Reinforced Polymer Poles for Transmission Lines, by Sherif Mohamed Ibrahim, a Thesis submitted to the Faculty of Graduate Studies, Department of Civil and Geological Engineering, The University of Manitoba, Winnipeg, Manitoba, Canada, Mar. 2000.

*Primary Examiner* — Charles A Fox
*Assistant Examiner* — Joseph J Sadlon
(74) *Attorney, Agent, or Firm* — Stites & Harbison, PLLC; Richard S. Myers, Jr.

(57) ABSTRACT

A method of modular pole construction an elongate modular pole structure is disclosed. A first step of the method involves providing hollow tapered pole section modules, each module having a first open end and an opposed second open end. A cross-section of the second end is less than a cross-section of the first end. The modules are stacked to form an elongated modular pole structure of a selected length by mating the second end of a first module with the first end of a second module. The first and second modules may have different structural properties, such that poles having desired structural properties can be constructed by selectively combining modules having differing structural properties.

23 Claims, 7 Drawing Sheets

(51) Int. Cl.

| | |
|---|---|
| ***E04H 12/02*** | (2006.01) |
| ***E04H 12/08*** | (2006.01) |
| *E04H 12/00* | (2006.01) |

(56) References Cited

U.S. PATENT DOCUMENTS

| | | | | | |
|---|---|---|---|---|---|
| 460,826 | A | * | 10/1891 | Knause | 52/301 |
| 1,722,671 | A | * | 7/1929 | Lingo | 29/897.33 |
| 1,786,631 | A | * | 12/1930 | Roe | 52/223.5 |
| 1,877,583 | A | * | 9/1932 | Pfaff | 29/897.33 |
| 2,036,771 | A | | 4/1936 | Pfistershamer | |
| 2,278,894 | A | * | 4/1942 | Paulson | 446/117 |
| 2,702,103 | A | | 2/1955 | Pfistershamer | |
| 3,034,209 | A | | 5/1962 | Bianca | |
| 3,270,480 | A | | 9/1966 | Beecker | |
| 3,571,991 | A | * | 3/1971 | Doocy | E04H 12/24 52/295 |
| 3,594,973 | A | * | 7/1971 | Archer et al. | 52/711 |
| 3,713,262 | A | | 1/1973 | Jatcko | |
| 3,896,858 | A | | 7/1975 | Whatley | |
| 3,897,662 | A | * | 8/1975 | Fencl | 52/79.2 |
| 3,936,206 | A | | 2/1976 | Meisberger | |
| 4,007,075 | A | | 2/1977 | McClain | |
| 4,173,853 | A | * | 11/1979 | Logan | 52/57 |
| 4,246,732 | A | * | 1/1981 | Frehner | 52/848 |
| 4,523,003 | A | | 6/1985 | Bezwada | |
| 4,699,601 | A | * | 10/1987 | Hershfeld | 446/69 |
| 4,748,192 | A | | 5/1988 | Smith | |
| 4,751,804 | A | * | 6/1988 | Cazaly | 52/651.02 |
| 4,939,037 | A | * | 7/1990 | Freeman et al. | 428/36.3 |
| 5,060,437 | A | * | 10/1991 | Parsons et al. | 52/298 |
| 5,162,388 | A | | 11/1992 | Primeaux, II | |
| 5,175,971 | A | | 1/1993 | McCombs | |
| 5,222,344 | A | | 6/1993 | Johnson | |
| 5,323,573 | A | * | 6/1994 | Bakewell, III | 52/86 |
| 5,333,436 | A | | 8/1994 | Noble | |
| 5,480,955 | A | | 1/1996 | Primeaux, II | |
| 5,492,579 | A | | 2/1996 | Hosford et al. | |
| 5,513,477 | A | | 5/1996 | Farber | |
| 5,529,429 | A | * | 6/1996 | Pelegrin | 404/9 |
| 5,704,187 | A | * | 1/1998 | Hosford et al. | 52/848 |
| 5,783,013 | A | | 7/1998 | Beckman et al. | |
| 5,784,851 | A | * | 7/1998 | Waugh | 52/848 |
| 5,910,369 | A | | 6/1999 | Macris et al. | |
| 6,155,017 | A | | 12/2000 | Turner | |
| 6,167,673 | B1 | * | 1/2001 | Fournier | 52/848 |
| 6,258,918 | B1 | | 7/2001 | Ho et al. | |
| 6,286,281 | B1 | | 9/2001 | Johnson | |
| 6,312,815 | B1 | | 11/2001 | Macris et al. | |
| 6,357,196 | B1 | | 3/2002 | McCombs | |
| 6,367,225 | B1 | | 4/2002 | Ashton | |
| 6,399,881 | B2 | | 6/2002 | Edelstein | |
| 6,420,493 | B1 | | 7/2002 | Ryckis-Kite et al. | |
| 6,446,408 | B1 | * | 9/2002 | Gordin et al. | 52/632 |
| 6,453,635 | B1 | | 9/2002 | Turner | |
| 6,730,382 | B2 | * | 5/2004 | Fanucci et al. | 428/36.9 |
| 6,852,418 | B1 | | 2/2005 | Zurbig et al. | |
| 7,762,041 | B1 | * | 7/2010 | Wawrzeniak | E04C 3/32 403/359.6 |
| 2001/0013419 | A1 | | 8/2001 | Edelstein | |
| 2002/0069596 | A1 | * | 6/2002 | Ritz | 52/148 |
| 2003/0219561 | A1 | | 11/2003 | Maybee | |
| 2004/0006947 | A1 | | 1/2004 | Ashton | |
| 2004/0081830 | A1 | | 4/2004 | Croley | |
| 2004/0228995 | A1 | | 11/2004 | Boaz et al. | |
| 2005/0038222 | A1 | | 2/2005 | Joshi et al. | |
| 2005/0146864 | A1 | | 7/2005 | Haddad | |
| 2005/0160697 | A1 | | 7/2005 | Oliphant | |
| 2005/0166521 | A1 | * | 8/2005 | Silber | 52/633 |
| 2005/0211963 | A1 | | 9/2005 | Enns | |
| 2005/0271845 | A1 | | 12/2005 | Boynoff | |
| 2008/0274319 | A1 | * | 11/2008 | Berksoy et al. | 428/36.91 |

FOREIGN PATENT DOCUMENTS

| | | | | | |
|---|---|---|---|---|---|
| DE | 3718436 | A1 | * | 12/1988 | E04B 1/35 |
| GB | 319163 | | | 11/1933 | |
| WO | 8602689 | | | 5/1986 | |
| WO | 9848947 | | | 11/1998 | |
| WO | 99/47770 | | | 9/1999 | |
| WO | 01/90504 | | | 11/2001 | |
| WO | 03085022 | | | 10/2003 | |
| WO | 2005057520 | | | 6/2005 | |
| WO | 2005067544 | | | 7/2005 | |
| WO | 2005085562 | | | 9/2005 | |
| WO | 2006019478 | | | 2/2006 | |

* cited by examiner

METHOD OF MODULAR POLE CONSTRUCTION AND MODULAR POLE ASSEMBLY

FIELD OF INVENTION

The present invention relates to a method of modular pole construction and a modular pole assembly constructed in accordance with the teachings of the method.

BACKGROUND OF THE INVENTION

Pole structures are used for a variety of purposes, such as, but not limited to highway luminaire supports and utility poles for telephone, cable and electricity. These pole structures are typically made from materials such as wood, steel and concrete. Whilst the use of these pole structures is extensive, it is limited as they tend to be one piece structures, therefore the height, strength and other properties are fixed.

Poles of a given length can be designed in multiple sections for ease of transporting by truck, railroad, or even cargo plane and to aid erection in the field. This is common with steel and indeed some concrete pole structures. U.S. Pat. No. 6,399,881 discloses a multi-sectional utility pole including at least two sections of straight pipe, which are joined and connected by a slip joint connection. The slip joint consists of two mating conical sections, with one attached to each section of the pole. However, whilst this approach may aid the transportation and erection, this does not address other issues within the structure such as height, strength, stiffness, durability and other performance considerations.

SUMMARY OF THE INVENTION

The present invention relates to a method of modular pole construction and a modular pole assembly constructed in accordance with the teachings of the method.

It is an object of the invention to provide an improved modular pole assembly and method of constructing the pole assembly.

According to the present invention there is provided a method of modular pole construction, comprising the steps of:

providing two or more than two hollow tapered pole section modules, each module having a first open end and an opposed second open end, a cross-sectional area of the second end being less than a cross-sectional area of the first end; and stacking the two or more than two modules to form an elongated modular pole structure of a selected length by mating the second end of a first module with the first end of a second module;

wherein the first and second modules have different structural properties, such that poles having desired structural properties can be constructed by selectively combining modules having differing structural properties.

The present invention pertains to a method of modular pole construction as just defined wherein the different structural properties is selected from the group consisting of flexural strength, compressive strength, resistance to buckling, shear strength, outer shell durability and a mixture thereof. For example, the first module may have a greater compressive strength than the second module.

The present invention pertains to a method of modular pole construction as just defined, wherein in the step of providing, the first and second modules are nested, so that at least a portion of the second module nests within the first module. The whole of the second module may nest within the first module.

The present invention pertains to a method of modular pole construction as just defined wherein in the step of providing, the two or more than two tapered pole section modules are tubular in cross-section.

The present invention pertains to a method of modular pole construction as just defined, wherein after the step of stacking, there is a further step of positioning a cap at one or both ends of the elongated modular pole structure, thereby inhibiting entry of debris or moisture into the pole.

The present invention pertains to a method of modular pole construction as just defined wherein the elongated modular pole structure is an upright structure with a base module, a tip module and optionally one or more than one modules therebetween, the first end of the base module adjacent a surface. The method may further comprise positioning a support member at the first end of the base module to support and distribute the weight of the upright structure on the surface. The support member may have an aperture therethrough, such that liquids within the upright extended modular pole structure can drain through the aperture.

The present invention pertains to a method of modular pole construction as just defined wherein the two or more than two hollow tapered pole section modules are comprised of a composite material. The composite material may be a filament wound polyurethane composite material.

The present invention pertains to an elongated modular pole structure comprising at least a first and a second hollow tapered module, each module having a first end and an opposed second end, a cross-sectional area of the second end being less than a cross-sectional area of the first end, wherein the second end of a first module is mated with the first end of a second module and the first and second modules have different structural properties. Poles having desired structural properties can be constructed by selectively combining modules having differing structural properties. The differing structural properties may be selected from the group consisting of flexural strength, compressive strength, resistance to buckling, shear strength, outer shell durability and a mixture thereof.

The present invention pertains to an elongated modular pole structure as just defined wherein the second end of the first module is matingly received within the first end of the second module.

The present invention pertains to an elongated modular pole structure as just defined, wherein the first module has a greater internal dimension than the external dimension of the second module, such that at least a portion of the second module nests within the first module. The whole of the second module may nest within the first module and the first module may have a greater compressive strength than the second module.

The present invention pertains to an elongated modular pole structure as just defined including a cap positioned at one or both ends of the extended modular pole structure, thereby inhibiting entry of debris or moisture into the pole structure.

The present invention pertains to an elongated modular pole structure as just defined wherein the extended modular pole structure is an upright structure with a base module, a tip module and optionally one or more than one modules therebetween. The first end of the base module may be adjacent a surface and a support member may be positioned at the first end of the base module to support and distribute the weight of the elongated modular pole structure on the surface. The support member may have an aperture therethrough, such that liquids within the upright extended modular pole structure can drain through the aperture.

The present invention pertains to an elongated modular pole structure as just defined wherein the first and second hollow tapered modules are tubular.

The present invention pertains to an elongated modular pole structure as just defined wherein the first and second hollow tapered modules comprise composite material. The composite material may comprise a filament wound polyurethane composite material.

The present invention pertains to an elongated composite modular pole structure comprising at least a first and second hollow tapered module, each module comprising a composite material and having a first end and an opposed second end, a cross-sectional area of the second end being less than a cross-sectional area of the first end, wherein the second end of a first module is mated with the first end of a second module.

The present invention pertains to an elongated composite modular pole structure as just defined, wherein the first module has a greater internal dimension than the external dimension of the second module, such that at least a portion of the second module nests within the first module. The whole of the second module may nest within the first module and the first module may have a greater compressive strength than the second module.

The present invention pertains to an elongated composite modular pole structure as just defined wherein the first and second modules have different structural properties, such that poles having desired structural properties can be constructed by selectively combining modules having differing structural properties. The differing structural properties may be selected from the group consisting of flexural strength, compressive strength, resistance to buckling, shear strength, outer shell durability and a mixture thereof.

The present invention pertains to an elongated composite modular pole structure as just defined including a cap positioned at one or both ends of the extended modular pole structure, thereby inhibiting entry of debris or moisture into the pole structure.

The present invention pertains to an elongated composite modular pole structure as just defined wherein the extended modular pole structure is an upright structure with a base module, a tip module and optionally one or more than one modules therebetween. The first end of the base module is adjacent a surface and a support member may be positioned at the first end of the base module to support and distribute the weight of the elongated modular pole structure on the surface. The support member may have an aperture therethrough, such that liquids within the upright extended modular pole structure can drain through the aperture.

The present invention pertains to an composite elongated modular pole structure as just defined wherein the first and second hollow tapered modules are tubular.

The present invention pertains to an elongated composite modular pole structure as just defined wherein the composite material comprises a filament wound polyurethane composite material.

The present invention further pertains to a hollow tapered module for use in constructing an elongated modular pole structure, the module comprising a composite material and having a first end and an opposed second end, a cross-section of the second end being less than a cross-section of the first end. The composite material may comprise a filament wound polyurethane composite material.

The present invention pertains to an elongated modular pole structure comprising at least a first and second hollow tapered module, each module having a first end and an opposed second end, a cross-section of the second end being less than a cross-section of the first end, wherein the second end of the first module is mated with the first end of the second module and the first module has a greater internal dimension than the external dimension of the second module, such that at least a portion of the second module can nest within the first module for ease of transport of the modules. The whole of the second module may nest within the first module and the first module may have a greater compressive strength than the second module.

The present invention pertains to a kit comprising at least a first and second hollow tapered module for use in constructing an elongated modular pole structure, each module having a first end and an opposed second end, a cross-sectional area of the second end being less than a cross-sectional area of the first end, wherein the second end of the first module is configured to mate with the first end of the second module and the first module has a greater internal dimension than the external dimension of the second module, such that at least a portion of the second module nests within the first module.

The present invention pertains to a kit as just defined wherein the whole of the second module nest within the first module. The first module may have a greater compressive strength than the second module.

The present invention pertains to a kit as just defined wherein the second end of the first module is configured to be matingly received within the first end of the second module.

The present invention pertains to a kit as just defined wherein the first and second modules have different structural properties selected from the group consisting of flexural strength, compressive strength, resistance to buckling, shear strength, outer shell durability and a mixture thereof.

The present invention pertains to a kit as just defined wherein the first module has a greater compressive strength than the second module.

The present invention pertains to a kit as just defined wherein first and second modules are tubular.

The present invention pertains to a kit as just defined including a cap configured to mate with the first or second end of the first or second module to inhibit entry of debris or moisture.

The present invention pertains to a kit as just defined wherein the first and second modules comprise composite material. The composite material may comprise filament wound polyurethane composite material.

The present invention pertains to a kit comprising at least a first and second hollow tapered module for use in constructing an elongated modular pole structure, each module having a first end and an opposed second end, a cross-section of the second end being less than a cross-section of the first end, wherein the second end of the first module is configured to mate with the first end of the second module and the first and second modules have different structural properties. The different structural properties may be selected from the group consisting of flexural strength, compressive strength, resistance to buckling, shear strength, outer shell durability and a mixture thereof.

The present invention further pertains to a system for assembling an elongated modular pole structure, the system comprising hollow tapered tubular pole section modules made from fiber reinforced composites, the modules having an open bottom end and a relatively narrow top end and being stacked to form a vertical structure of a selected height by mating the bottom end of an overlying module with the top end of an underlying module, some of the modules having different properties relating to at least one of flexural strength, compressive strength, or shear strength, such that poles having desired properties of flexural strength, compressive strength and shear strength can be constructed by selectively combining modules having differing properties.

By using hollow modules that are tapered so that one end of each module has a larger cross sectional area than the other end of the module, allows an elongate modular pole structure to be assembled by stacking modules whereby the larger end of one module mates with the smaller end of a second module. The modules may be specifically engineered with different structural properties so that modules can be selectively combined to provide poles having a number of different structural property combinations, thus providing a modular solution to the problem of having to satisfy varying performance criteria, without requiring a separate pole or structure for each condition.

By providing modules that may be shaped so that they can nest one within the other, allows for easy storage and transportation of the modules required for assembly of an elongate modular pole structure. Furthermore, by using modules made of composite material, especially filament wound polyurethane composite material, the elongate modular pole structure is light, strong and durable and the structural properties of the modules can be easily varied by changing the type, amount or make up of the reinforcement and/or resin component of the composite material.

This summary of the invention does not necessarily describe all features of the invention.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION

Figure 1:
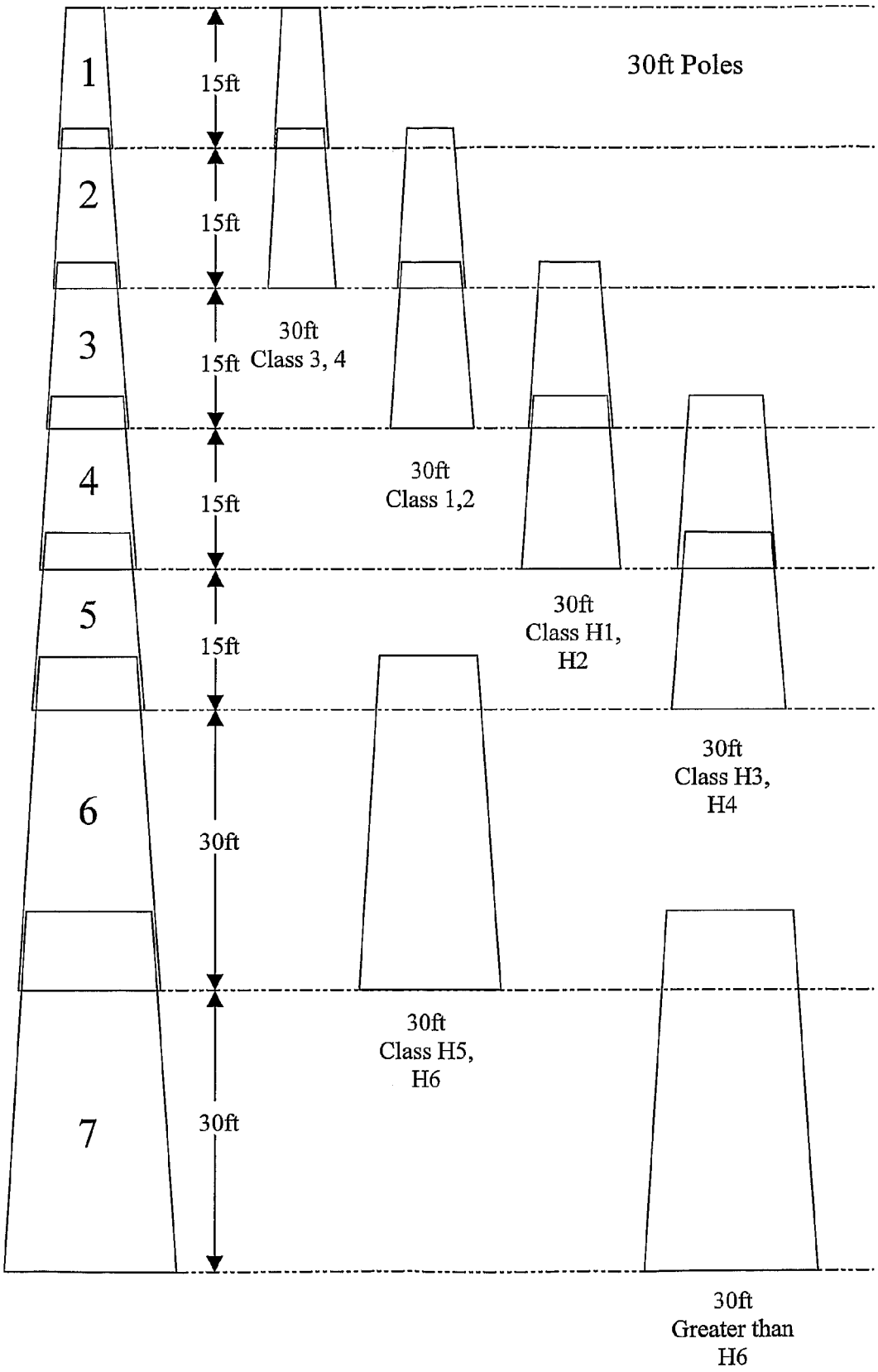
FIG. 1 is a side elevation view, in section, of an example of an embodiment of the module pole assembly of the present invention, where a series of modules are used to construct a range of 30 ft poles of varying strength and stiffness.

The following description is of a preferred embodiment.

The present invention pertains to an elongated modular pole structure or modular pole assembly or system comprising two or more than two hollow tapered modules. Each module has a first end and an opposed second end with the cross-sectional area of the second end being less than the cross-sectional area of the first end. The second end of one module is mated with the first end of a second module to form the pole structure.

At least two of the modules may have different structural properties, such that poles having desired structural properties can be constructed by selectively combining modules having differing structural properties. The modules may have different flexural strength, compressive strength, resistance to buckling, shear strength, outer shell durability or a mixture of different structural properties. The height of the structure can also be varied simply by adding or removing modules from the stack. In this way a system is provided whereby a series of modules has the potential to assemble modular pole structures that can vary not only in strength but also stiffness or other characteristics for any desired height.

The modules may be configured, such that two or more modules are stacked one on top of the other, such that the top or second end of one module slips into, or is matingly received within, the base or first end of another module to a predetermined length to provide an elongated modular pole structure or modular pole assembly. Alternatively, the modules may be configured such that the base or first end of one module slips into, or is matingly received within the top or second end of another module. The overlaps of these joint areas may be predetermined so that adequate load transfer can take place from one module and the next. This overlap may vary throughout the structure generally getting longer as the modules descend in order to maintain sufficient load transfer when reacting against increasing levels of bending moment.

The joints are designed so they will affect sufficient load transfer without the use of additional fasteners, for example press fit connections, bolts, metal banding and the like. However, a fastener may be used sometimes in situations where the stack of modules is subjected to a tensile (upward force) rather than the more usual compressive (downwards force) or flexural loading.

When the modules are stacked together they behave as a single structure able to resist forces, for example, but not limited to, lateral, tensile and compression forces, to a predetermined level. The height or length of the structure can be varied simply by adding or removing modules from the stack. The overall strength of the structure can be altered without changing the length, simply by removing a higher module from the top of the stack and replacing the length by adding a larger, stronger module at the base of the stack. In this way the structure can be engineered to vary not only strength but also stiffness characteristics for any desired height or length. Desired properties of a structure can therefore be constructed by selectively combining modules having differing properties. For example, the modules may have different strength properties, for example the modules may have a horizontal load strength from about 300 to about 11,500 lbs, or any amount therebetween, or a horizontal load strength from about 1500 to about 52,000 Newtons, or any amount therebetween. The modules may have a strength class selected from the group consisting of class 1, 2, 3, 4, 5, 6, 7, 8, 9, 10, H1, H2, H3, H4, H5 and H6 of ANSI O5.1-2002 as shown in Table 1. By using modules with these strength characteristics, the resultant elongated modular pole structure or assembly may have a horizontal load strength from about 300 to about 11,500 lbs, or any amount therebetween, or a horizontal load strength from about 1500 to about 52,000 Newtons. The elongate modular pole structure or assembly may have a strength class selected from the group consisting of class 1, 2, 3, 4, 5, 6, 7, 8, 9, 10, H1, H2, H3, H4, H5 and H6 of ANSI O5.1-2002 as shown in Table 1.

A multitude of uses, both temporary and permanent, are possible for the upright modular pole system as described herein. For example, the structure may be used as, but not limited to, a utility pole, a support poles for security camera, a support for highway luminaries, a support structure for recreational lights for sport fields, ball fields, tennis courts, and other outdoor lighting such as parking lots and street lighting.

The modular pole assembly need not be an upright structure, for example the modules may be mated together to form a hollow pipe or shaft used to convey liquids or gas or the like either above or under the ground or water. Using strong, lightweight modules, that may be configured to nest one within the other, allows easy transportation to and storage of the modules at the site of construction of the pipe or shaft. The pipe or shaft can be easily constructed in the field by mating the modules together. This is particularly advantageous in remote locations, such as oil fields and water, gas or sewage transportation systems.

In one embodiment, the internal dimensions of a first or larger module is greater than the external dimensions of a second or smaller module, such that at least a portion of the second module can nest within the first module. Preferably, the whole of the second module can best within the first module (e.g. FIG. 7). In this way, the two or more modules that make up a particular modular pole structure can be nested one within the other. The nested modules offers handling, transportation and storage advantages due to the compactness and space saving Each module may be a hollow uniformly tapered tubular pole section (e.g. 50, FIG. 8) having an open base (or first) end (e.g. 52, FIG. 8) and an opposed tip (or second) end (e.g. 54, FIG. 8), the diameter of the tip end being less than the diameter of the base end. The modules are not limited to being tubular shaped and other shapes are within the scope of the present invention, for example, but not limited to, oval, polygonal, or other shapes with a non-circular cross-section such as, but not limited to, square, triangle or rectangle, provided the cross-section, or cross sectional area, of the second end of each module is less than the cross-section, or cross sectional area, of the first end.

Figure 8:
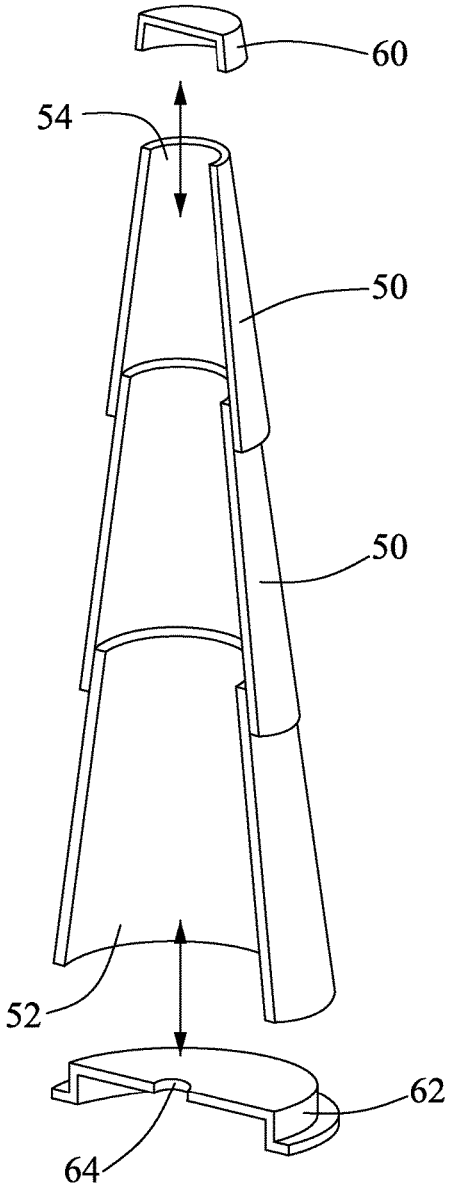
FIG. 8 is an exploded perspective view, in section, of an example of an embodiment of the module pole assembly of the present invention, where several modules are stacked one on top of the other, together with mating top cap and mating bottom plug.

As is illustrated in FIG. 1 to FIG. 5, modules may be stacked to form a vertical structure of a selected height. Referring to FIG. 8, this is accomplished by mating bottom end 52 of an overlying module 50A with top end 54 of an underlying module 50B. The resulting vertical structure has a base module positioned adjacent to or embedded in a surface such as the ground, an opposed tip module spaced from the surface or ground and optionally one or more than one modules therebetween. A support member or bottom plug (e.g. 62, FIG. 8) may be positioned at the first end of the base module to support and distribute the weight of the elongated modular pole structure on the surface, thereby increasing the stability of the foundation and preventing the hollow pole like structure from being depressed into the ground under compressive loading. The support member may have an aperture therethrough, such that liquids within the upright extended modular pole structure can drain through the aperture.

A cap may be provided to fit or mate with one or both ends of the modular pole, pipe or shaft structure, thereby inhibiting entry of debris or moisture into the structure. The cap may be configured to mate with the end of the modular structure, for example, but not limited to, a press fit connection. Alternatively, fasteners for example, bolts, screws, banding, springs, straps and the like, may be provided for positioning the cap in place.

When the modules are configured to nest one within the other (e.g. FIG. 7), a cap may be configured to mate with the first end of the largest or first module. Provision of a cap on the base or first end of the largest module inhibits entry of debris and moisture into the nested modules during transport and storage of the modules. The bottom plug or support member as hereinbefore described may be used for this purpose when the modules are nested together and then utilized to support the base of the elongate vertical modular pole structure upon assembly.

One embodiment is to provide a modular utility pole for use in the electrical utility industry which has traditionally used steel and wood as distribution and transmission poles. For this application, a pole has to be of a defined height and have a specified minimum breaking strength and usually a defined deflection under a specified load condition. Poles can be specified to carry power lines across a terrain and accommodate any topography and structural forces resulting from effects such as wind and ice loading.

The electrical utility industry typically uses poles in lengths of 25 ft to 150 ft. These poles vary in length and in their strength requirements. Table 1 shows the strength or horizontal load that the poles must attain in order to fall within ANSI O5.1-2002 standard strength class used in the industry. Poles may be selected for use in different structural applications depending on strength requirements for that application.

TABLE 1

Horizontal load applicable to different strength classes of utility poles

| StrengthClass (ANSI O5.1-2002) | Horizontal Load (Pounds) | Horizontal Load (Newtons) |
|---|---|---|
| H6 | 11,400 | 50,710 |
| H5 | 10,000 | 44,480 |
| H4 | 8,700 | 38,700 |
| H3 | 7,500 | 33,360 |
| H2 | 6,400 | 28,470 |
| H1 | 5,400 | 24,020 |
| 1 | 4,500 | 20,020 |
| 2 | 3,700 | 16,500 |
| 3 | 3,000 | 13,300 |
| 4 | 2,400 | 10,680 |
| 5 | 1,900 | 8,450 |

TABLE 1-continued

Horizontal load applicable to different strength classes of utility poles

| StrengthClass (ANSI O5.1-2002) | Horizontal Load (Pounds) | Horizontal Load (Newtons) |
|---|---|---|
| 6 | 1,500 | 6,670 |
| 7 | 1,200 | 5,340 |
| 9 | 740 | 3,290 |
| 10 | 370 | 1,650 |

If a range of different pole sizes and different pole strength classes are required, then the amount of inventory necessary is a multiple of these two parameters. In situations where absolute flexibility is required, huge stocks of poles are needed. This is common in instances where utility companies maintain emergency replacement poles to repair lines after storms or other such events. As they cannot predict which structure may be damaged they have to keep spare poles of every height and classification.

In one embodiment of the present invention a series or kit of modules is provided having a plurality of modules. The modules may be of different sizes with the largest or first module having a greater internal dimension than the external dimensions of the next largest or second module, such that at least a portion of the second module nests within the first module. Preferably, the whole of the second module nests within the first module (e.g. FIG. 7). Additional modules may be provided that are gradually smaller in size, enabling the modules to nest together for ease of transport and storage. Alternatively, or additionally some or all of the modules in the series or kit may have different structural properties, for example, but not limited to, different flexural strength, compressive strength, resistance to buckling, shear strength, outer shell durability or a mixture of different structural properties. For example, a larger (first) module may have a greater compressive strength than a smaller (second) module, such that the module having lesser strength nests within the module of greater strength, thereby protected the modules during transport and storage.

The kit may be used to construct a modular pole assembly or structure whereby the modules may be configured so that the tip (second end) of the first or largest module fits inside or is matingly received within the base (first end) of the second or smaller module. Alternatively, the base (first end) of second or smaller module may be configured so it will fit inside or is matingly received within the tip (second end) of the second or largest module.

In one embodiment of the present invention the modules are made from composite material.

By the term "composite material" it is meant a material composed of reinforcement embedded in a polymer matrix or resin, for example, but not limited to, polyester, epoxy, polyurethane, or vinylester resin or mixtures thereof. The matrix or resin holds the reinforcement to form the desired shape while the reinforcement generally improves the overall mechanical properties of the matrix.

By the term "reinforcement" it is meant a material that acts to further strengthen a polymer matrix of a composite material for example, but not limited to, fibers, particles, flakes, fillers, or mixtures thereof. Reinforcement typically comprises glass, carbon, or aramid, however there are a variety of other reinforcement materials, which can be used as would be known to one of skill in the art. These include, but are not limited to, synthetic and natural fibers or fibrous materials, for example, but not limited to polyester, polyethylene, quartz, boron, basalt, ceramics and natural reinforcement such as fibrous plant materials, for example, jute and sisal.

The composite module of the present invention is configured for stacking in a modular pole assembly and advantageously provides a lightweight structure that displays superior strength and durability when compared to the strength and durability associated with wood or steel poles. Reinforced composite modules do not rust like steel and they do not rot or suffer microbiological or insect attack as is common in wood structures. Furthermore, reinforced composite structures, in contrast to natural products (such as wood), are engineered so the consistency and service life can be closely determined and predicted.

The composite module may be made using filament winding. However, other methods may be used also be utilized to produce the composite module, such as, but not limited to resin injection molding, resin transfer molding and hand lay-up forming applications.

A typical filament winding set-up is described in CA 2,444,324 and CA 2,274,328 (which is incorporated herein by reference). Fibrous reinforcement, for example, but not limited to glass, carbon, or aramid, is impregnated with resin, and wound onto an elongated tapered mandrel.

The resin impregnated fibrous material is typically wound onto the mandrel in a predetermined sequence. This sequence may involve winding layers of fibres at a series of angles ranging between 0° and 87° relative to the mandrel axis. The direction that the fibrous reinforcement is laid onto the mandrel may effect the eventual strength and stiffness of the finished composite module. Other factors that may effect the structural properties of the manufactured module include varying the amount of fibrous reinforcement to resin ratio, the wrapping sequence, the wall thickness and the type of fibrous reinforcement (such as glass, carbon, aramid) and the type of resin (such as polyester, epoxy, vinylester). The structural properties of the module can be engineered to meet specific performance criteria. In this way, the laminate construction can be configured to produce a module that is extremely strong. The flexibility of the module can also be altered such that a desired load deflection characteristic can be obtained. By adjusting the laminate construction, properties such as resistance to compressive buckling or resistance to point loads can be achieved. The former being of value when the modules experience high compressive loads. The latter is essential when modules are designed for load cases where heavy equipment is bolted to the sections exerting point loads and stress concentrations that require a high degree of transverse laminate strength.

In one embodiment of the present invention the modules comprise filament wound polyurethane composite material. By the term "filament wound polyurethane composite material" it is meant a composite material that has been made by filament winding using a fibrous reinforcement embedded in a polyurethane resin or reaction mixture. The polyurethane resin is made by mixing a polyol component and a polyisocyanate component. Other additives may also be included, such as fillers, pigments, plasticizers, curing catalysts, UV stabilizers, antioxidants, microbiocides, algicides, dehydrators, thixotropic agents, wetting agents, flow modifiers, matting agents, deaerators, extenders, molecular sieves for moisture control and desired colour, UV absorber, light stabilizer, fire retardants and release agents.

By the term "polyol" it is meant a composition that contains a plurality of active hydrogen groups that are reactive towards the polyisocyanate component under the conditions of processing. Polyols described in U.S. Pat. No.

6,420,493 (which is incorporated herein by reference) may be used in the polyurethane resin compositions described herein.

By the term "polyisocyanate" it is meant a composition that contains a plurality of isocyanate or NCO groups that are reactive towards the polyol component under the conditions of processing. Polyisocyanates described in U.S. Pat. No. 6,420,493 (which is incorporated herein by reference) may be used in the polyurethane resin compositions described herein.

As hereinbefore described in more detail, the composite modules are constructed from reinforcement and a liquid resin. By arranging the reinforcement in a particular way, strength and stiffness performance can be tuned to give a value required. By altering the constituent materials and constructions from which the modules are constructed, significant increases in the durability of the structures can be obtained. A typical example of this is to produce top modules in a stack with high levels of unidirectional and hoop reinforcement in order to maximize flexural stiffness and limit deflection. The lower modules would utilize more off axis and hoop reinforcement and greater wall thickness to counteract the effects of large bending moments and compressive buckling. In this example the foundation modules not only vary in construction and wall thickness but also in the material used to maximize durability. The base modules may be planted in earth or rock to provide a foundation for the stack and as such are exposed to a series of contaminants and ground water conditions which can cause premature deterioration. In this instance, the type of reinforcement and resin system for the base (foundation) modules may be specified to maximize longevity and durability under these conditions. This approach affords tremendous flexibility and enables a pole like structure to be specified to meet a host of environments.

As a basic principle, the more durable the materials used in terms of reinforcement and liquid resin, the higher the cost. By only employing the high durability, high cost materials where they are required (such as the base modules) rather than for the complete stack, not only is durability significantly increased but it is achieved in a cost effective manner.

A further embodiment to enhance durability and service life is to add an aliphatic polyurethane composite material top coat to the modules. This provides a tough outer surface that is extremely resistant to weathering, ultra violet light, abrasion and can be coloured for aesthetics or identification.

FIG. 1 shows a series of modules stacked together to form a pole. Modules 1 to 5 are 15 ft long plus an allowance for the overlap length. Therefore, joining modules 1 and 2 results in a 30 ft pole. Joining modules 1, 2 and 3 results in a 45 ft pole. As each successive module is added the pole can increase in height at 15 ft intervals.

In cases where the stack does not begin with module 1, the resultant length includes the additional length of the overlap. For example. Modules 2, 3 and 4 would result in a pole like structure that would measure 45 ft plus the additional overlap length at the tip of module 2. If desired, the additional length can be simply cut off so the pole meets with height or tolerance requirements.

As herein before described in more detail, utility poles are not only classified in height but also their performance under loading conditions. The loading conditions are numerous but typically result in flexural loading (where power lines are simply spanned in a straight line) or flexural and compressive loading, which is common when down guys are attached to the pole at points where a power line changes direction or terminates. In order to satisfy the loading conditions, poles have to attain a minimum strength under flexural loading and in many cases must not exceed a specified deflection under a specified applied load. This is to prevent excessive movement of the conductors and to maximize the resistance to vertical buckling under compressive loading.

Each module may be designed to perform to predetermined strength and stiffness criteria both as individual modules and as part of a collection of stacked modules. In the embodiment wherein the elongate modular pole structure is a utility pole, the strength and stiffness criteria may be designed to comply with the strength classifications of wood poles as shown in Table 1. In this way, modules are stacked together to form a pole of the correct length and this stack is moved up or down the sequence of modules until the strength or stiffness, or both requirements are met. In this way a series of modules has the potential to make up many different length poles with differing strength capabilities.

Figure 6:
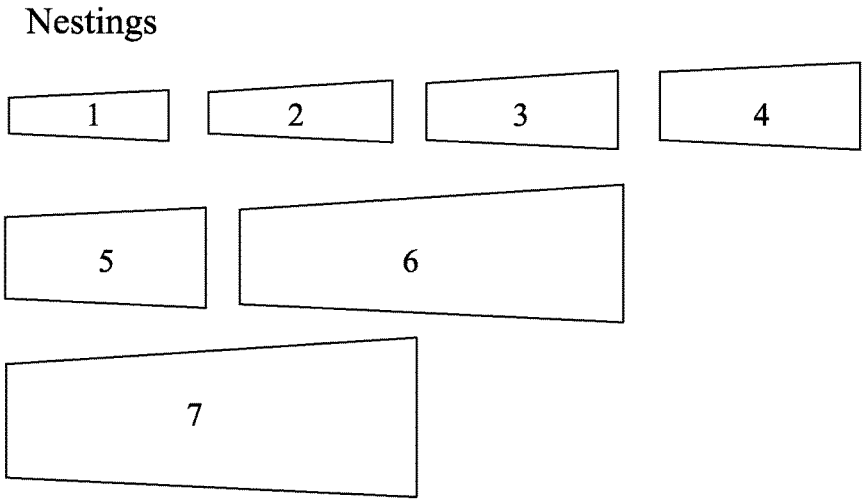
FIG. 6 is a side elevation view, in section, of an example of an embodiment of the modules which make up the module pole assembly of the present invention, showing seven differing sizes of modules.

FIG. 1 shows how a series of 30 ft pole like structures can be assembled from 7 modules. The 7 modules are shown individually in FIG. 6. In this embodiment, the modules have been designed so when they are stacked in groups they correspond to the strength requirements for wood poles as detailed in Table 1. There are 7 modules of which 5 are 15 ft long plus an amount to enable an overlap slip joint which attaches the ascending module. The strength of wood poles are set out in classes as shown in Table 1. In order for a pole to comply it must meet the length requirement and also be capable of resisting a load equal to that specified which is generally applied 2 ft (0.6 m) from the tip. The pole is restrained over a foundation distance which is typically 10% of the length of the pole plus 2 ft. It can be seen from FIG. 1 that stacking modules 1 and 2 result in a 30 ft pole like structure that complies with class 3 or 4 load as detailed in Table 1.

To satisfy a class rating, the pole has to resist failure during the fall application of the class load which acts over a length between the foundation distance and the point of application. In the example shown in FIG. 1, if modules 1 and 2 resist a 3,000 lbs loading in the manner specified they would be classified as equivalent to a 30 ft class 3 wood pole. It can be seen from FIG. 1 that modules 1 and 2 when stacked have the ability to comply with 30 ft class 3 or class 4 wood poles. The reason for the double classification is due to deflection under load. In many instances power companies require poles of a specified height and strength but on occasion they also specify maximum allowable deflection under loading. The maximum deflection is frequently related to the deflection of wood. This becomes relevant in particular cases where power lines change direction or are terminated. In this instance, deflection can be of importance.

In the example of FIG. 1, modules 1 and 2 can be stacked to form a pole like structure that will resist a class load of 3,000 lbs (class 3 load). However, under class 3 loading the deflection is higher than that usually demonstrated by wood, hence if deflection is important, this module combination matches class 4 loading (2,400 lbs) for strength and deflection. The practical value of this is that modules 1 and 2 would be used in class 3 loading conditions as tangent poles (where power lines typically run over relatively flat ground in a straight line). In instances of termination or change of direction when deflection becomes more relevant, modules 1 and 2 would be used to satisfy as a class 4 structure.

If the example in FIG. 1 is extended to modules 2 and 3, these can be stacked to produce a 30 ft pole like structure capable of class 1 or 2 class loading for the same reasons. All the other examples contained in FIG. 1-5 use the same methodology.

Figure 2:
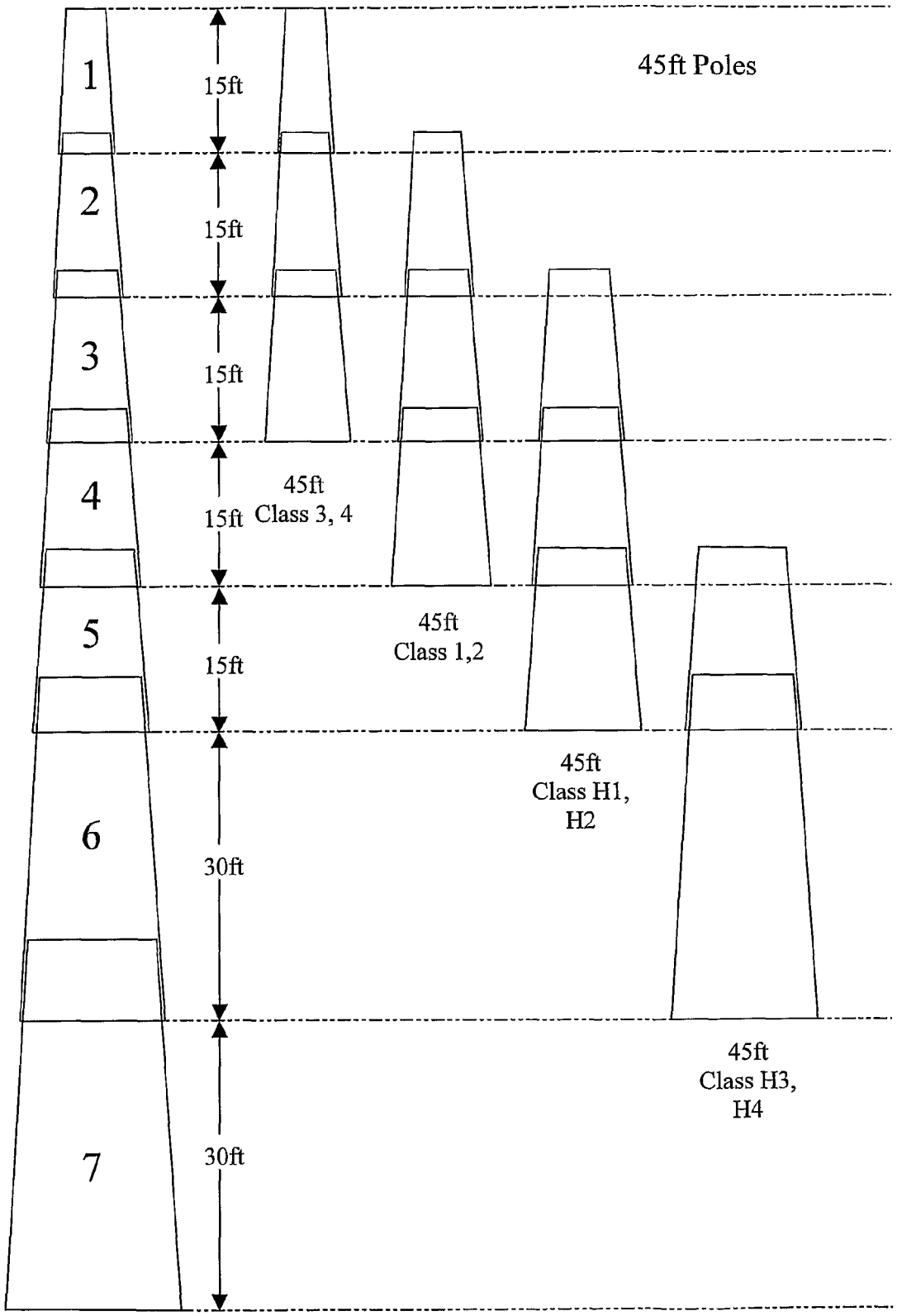
FIG. 2 is a side elevation view, in section, of an example of an embodiment of the module pole assembly of the present invention, where a series of modules are used to construct a range of 45 ft poles of varying strength and stiffness.
Figure 3:
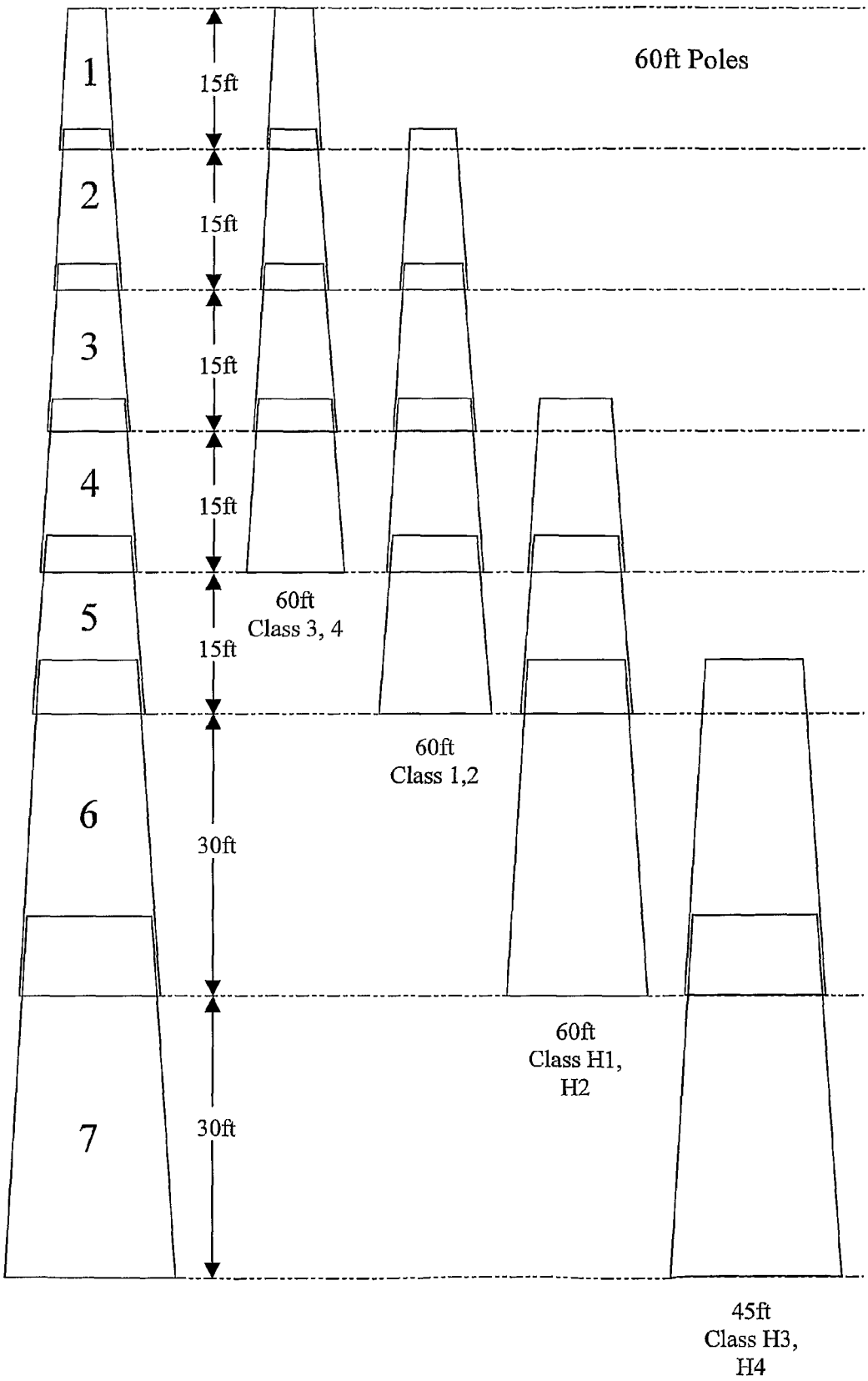
FIG. 3 is a side elevation view, in section, of an example of an embodiment of the module pole assembly of the present invention, where a series of modules are used to construct a range of 60 ft poles of varying strength and stiffness.
Figure 4:
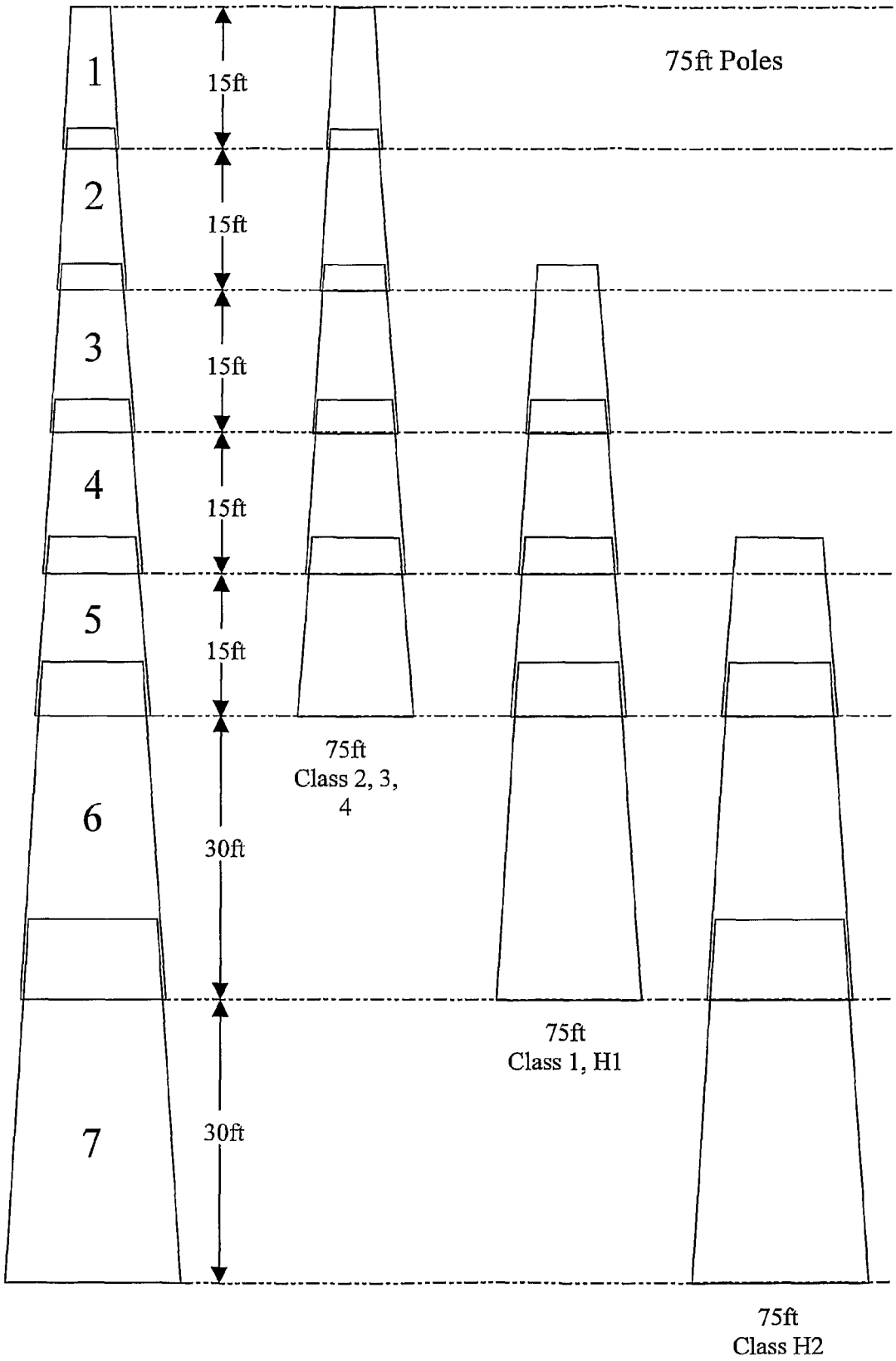
FIG. 4 is a side elevation view, in section, of an example of an embodiment of the module pole assembly of the present invention, where a series of modules are used to construct a range of 75 ft poles of varying strength and stiffness.
Figure 5:
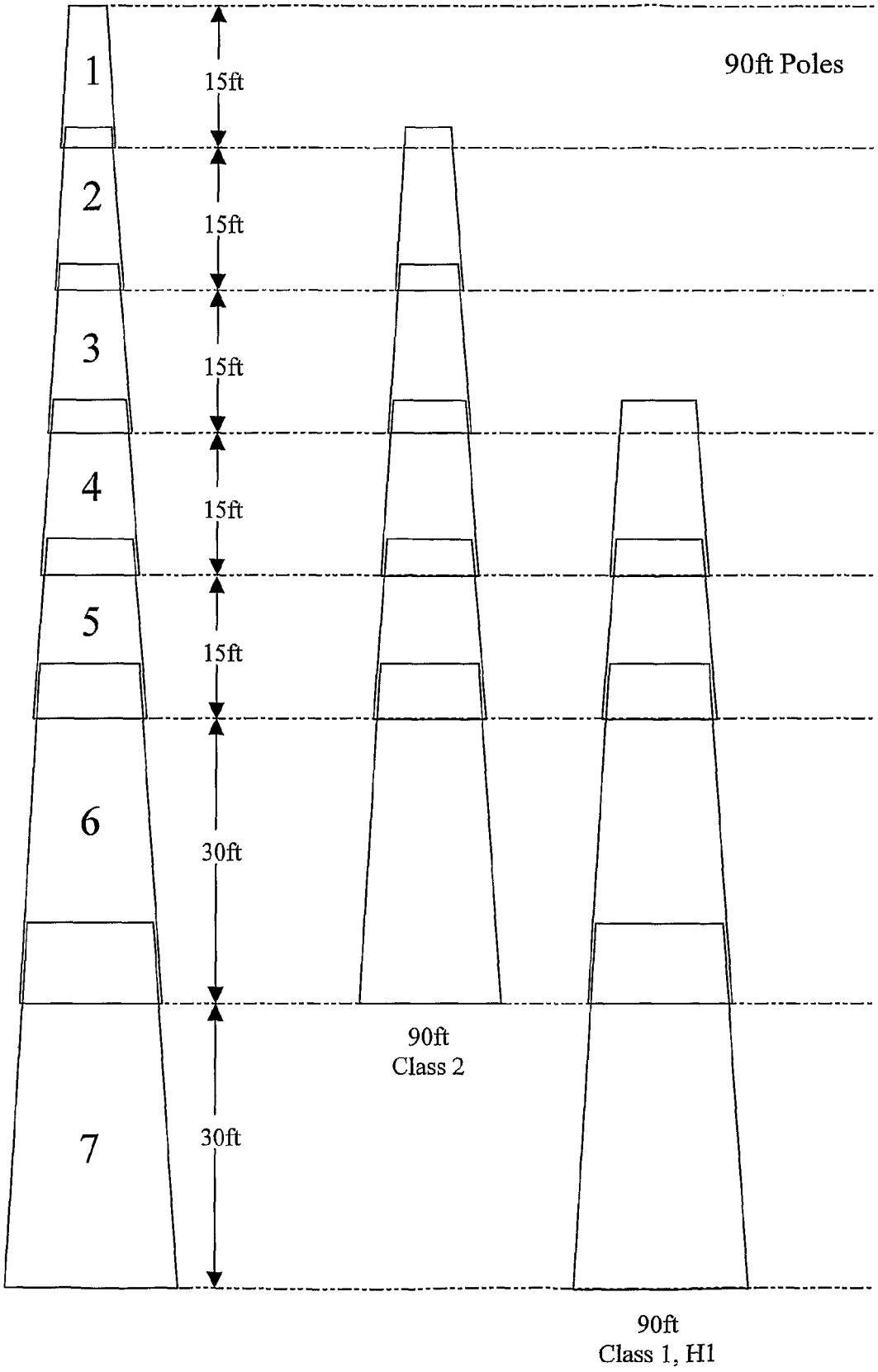
FIG. 5 is a side elevation view, in section, of an example of an embodiment of the module pole assembly of the present invention, where a series of modules are used to construct a range of 90 ft poles of varying strength and stiffness.
Figure 7:
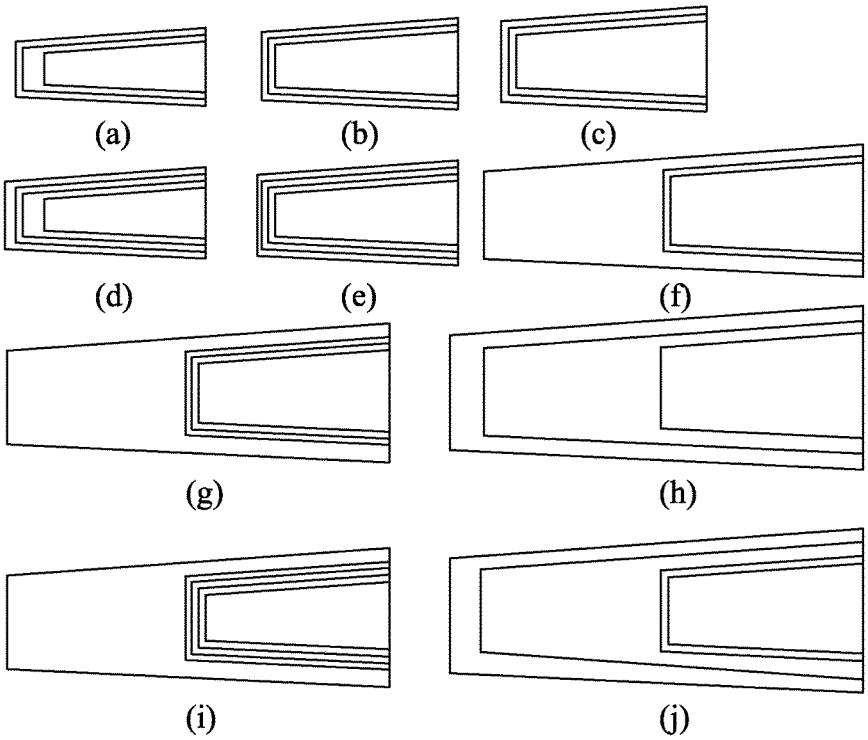
FIGS. 7(*a*)-(*j*) are side elevation views, in section, of an example of an embodiment of the modules which make up the module pole assembly of the present invention, with modules being nested together in preparation for transport.

Referring to FIG. 7, the tapers of the modules have been designed so that the ascending module fits inside the descending module. In other words the inner dimension of a larger module is greater than the external dimension of a smaller module that is able to nest within the larger module. This offers tremendous advantages when handling and transporting modules due to the compactness and space saving. In the embodiment wherein the module comprises composite material, there is also significantly reduced weight when compared to wood, steel or concrete. Modules can be nested together in small stacks. See FIG. 7 (*a*)-(*c*) for 45 ft pole examples, (*d*)-(*f*) for 60 ft pole examples, (*g*)-(*h*) for 75 ft pole examples, and (*i*)-(*j*) for 90 ft pole examples. For example, modules 1, 2 and 3 can be nested together which when assembled will form a 45 ft pole like structure with the strength characteristics as indicated in FIG. 2 (See FIG. 7(*a*)). Similarly modules 2, 3 and 4 can be nested together for transportation. (See FIG. 7(*b*)). When erected this will form a 45 ft pole like structure with higher strength characteristics as shown in FIG. 2. Clearly the modules required to stack together to form a 90 ft pole class 2 pole can be subdivided to form other constructions. (See FIG. 7(*i*) and (*j*)) In the example of 90 ft class 2, five modules are required (modules 2, 3, 4, 5 and 6). From this set of modules further structures can be assembled. For example, modules 2, 3 and 4 can be stacked to form a 45 ft class 1 or 2 pole. Modules 3, 4 and 5 can be stacked to form a 45 ft class H1 or H2 pole (see FIGS. 2 and 7(*c*))). Modules 5 and 6 can be stacked to form a 45 ft class H3 or H4 pole. Similarly, modules 2, 3, 4 and 5 can be assembled to form a 60 ft pole like structure with the strength capabilities corresponding to class 1 or 2 (See FIG. 7(*d*)). Modules 4, 5 and 6 can also be assembled to produce a 60 ft pole like structure with a strength capability corresponding to H1 or H2 class (See FIG. 7(*f*)). These are shown in FIG. 3. In the same way, modules 3, 4, 5 and 6 can be stacked to form a 75 ft pole like structure with a strength capability corresponding to class 1 or H1 (See FIG. 7(*g*)).

In essence, a stack of 7 modules has the capability of being erected in many ways. In this embodiment with just 7 modules, 19 variations of pole like structures can be assembled in heights from 30 ft to 90 ft and displaying a variety of strength and stiffness properties. It must be emphasized that this embodiment has used 30 ft-90 ft structures for illustration purposes constructed from 15 ft and 30 ft modules. The system is not limited to a minimum of 30 ft or indeed a maximum of 90 ft or 7 modules. The size of the modules are also not limited to those shown for illustration purposes. The complete system in either part or whole allows for flexibility and ease of erection.

The complete system in either part or whole nests inside itself for ease of transportation. FIG. 7 shows a modular system nested ready for shipping.

Referring to FIG. 8, a top cap 60 may be placed over top end 54 of an uppermost or tip module, thereby preventing entry of debris or moisture from above. A bottom plug or support member 62 may be placed into bottom end 52 of a lowermost or base module, thereby preventing entry of debris or moisture from below. One significant advantage attained from adding a bottom plug or support member is to increase the stability of the foundation and prevent the hollow pole like structure from being depressed into the ground under compressive loading. The plug or support member 62 may have an aperture or hole 64 therethrough to allow any moisture from within the modular pole structure to drain away.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

The present invention has been described with regard to one or more embodiments. However, it will be apparent to one skilled in the art that modifications may be made to the illustrated embodiment without departing from the spirit and scope of the invention as hereinafter defined in the Claims.

All citations are hereby incorporated by reference.

What is claimed is:

1. A method of modular pole construction, comprising the steps of:

providing two or more than two hollow tapered pole section modules, each module having a first open end and an opposed second open end, a cross-sectional area of the second end is less than a cross-sectional area of the first end, each module comprising composite material produced by filament winding of a resin infused fibrous reinforcement in continuous layers along the length of each module such that the wall thickness of the resin infused fibrous reinforcement at the second end is greater than the wall thickness of the resin infused fibrous reinforcement at the first end of each module; and stacking the two or more than two modules to form an elongated modular pole structure of a selected length by mating the second end of a first module with the first end of a second module;

wherein the first and second modules have different structural properties as a result of varying one or more than one property of the filament wound composite material selected from the group consisting of:

(a) angle of winding of the resin infused fibrous reinforcement;

(b) ratio of the fibrous reinforcement to the resin;

(c) wrapping sequence of the resin infused fibrous reinforcement;

(d) wall thickness;

(e) composition of the fibrous reinforcement;

(f) composition of the resin;

(g) composition of additives in the resin; and (h) a mixture thereof, and wherein the elongated modular pole structure has a desired structural property by selectively combining modules having different structural properties; and wherein the different structural properties is selected from the group consisting of flexural strength, compressive strength, resistance to buckling, shear strength, outer shell durability, stiffness and a mixture thereof.

2. The method as defined in claim 1, wherein the first module has a greater compressive strength than the second module.

3. The method as defined in claim 1, wherein the first module has a greater internal dimension than the external dimension of the second module, such that in the step of providing at least a portion of the second module nests within the first module.

4. The method as defined in claim 1, wherein the elongated modular pole structure is an upright structure with a base module, a tip module and optionally one or more than one modules therebetween, the method further comprises positioning a cap at the second end of the tip module of the elongated modular pole structure.

5. The method as defined in claim 1, wherein the elongated modular pole structure is an upright structure with a base module, a tip module and optionally one or more than one modules therebetween, the first end of the base module being adjacent a surface, the method further comprises positioning a support member at the first end of the base module to support and distribute the weight of the elongated modular pole structure on the surface.

6. The method as defined in claim 5, wherein the support member has an aperture therethrough.

7. The method as defined in claim 1, wherein the composite material comprises polyurethane composite material.

8. The method as defined in claim 1, wherein the first and second modules comprise an aliphatic polyurethane composite material top coat.

9. The method as defined in claim 1, wherein the first module and the second module are dimensioned such that the whole of the second module nests within the first module.

10. An elongated modular pole structure comprising an assembly of mated hollow tapered modules, wherein each module has a first end and an opposed second end, a cross-sectional area of the second end being less than a cross-sectional area of the first end, and each module comprises composite material produced by filament winding of a resin infused fibrous reinforcement in continuous layers along the length of each module such that the wall thickness of the resin infused fibrous reinforcement at the second end is greater than the wall thickness of the resin infused fibrous reinforcement at the first end of each module, whereby the second end of a first module is mated with the first end of a second module and the first and second modules have different structural properties as a result of varying one or more than one property of the filament wound composite material selected from the group consisting of:

(a) angle of winding of the resin infused fibrous reinforcement;
(b) ratio of the fibrous reinforcement to the resin;
(c) wrapping sequence of the resin infused fibrous reinforcement;
(d) wall thickness;
(e) composition of the fibrous reinforcement;
(f) composition of the resin;
(g) composition of additives in the resin; and
(h) a mixture thereof, and wherein the elongated modular pole structure has a desired structural property by selectively combining modules having different structural properties; and wherein the different structural properties is selected from the group consisting of flexural strength, compressive strength, resistance to buckling, shear strength, outer shell durability, stiffness and a mixture thereof.

11. The elongated modular pole structure as define in claim 10, wherein the elongated modular pole structure is an upright structure and has a base module, a tip module and optionally one or more than one modules therebetween and includes a cap positioned at the second end of the tip module of the elongated modular pole structure.

12. The elongated modular pole structure as defined in claim 10, wherein the elongated modular pole structure is an upright structure and has a base module, a tip module and optionally one or more than one modules therebetween, whereby the first end of the base module is adjacent a surface and a support member is positioned at the first end of the base module to support and distribute the weight of the elongated modular pole structure on the surface.

13. The elongated modular pole structure as defined in claim 12, wherein the support member has an aperture therethrough.

14. The elongated modular pole structure as defined in claim 10, wherein the composite material comprises polyurethane composite material.

15. The elongated modular pole structure as defined in claim 10, wherein the first and second modules comprise an aliphatic polyurethane composite material top coat.

16. A kit comprising at least a first and second hollow tapered module for use in constructing an elongated modular pole structure, each module having a first end and an opposed second end, a cross-section of the second end being less than a cross-section of the first end, and each module comprises composite material produced by filament winding of a resin infused fibrous reinforcement in continuous layers along the length of the module such that the wall thickness of the resin infused fibrous reinforcement at the second end is greater than the wall thickness of the resin infused fibrous reinforcement at the first end of each module, wherein the second end of the first module is configured to mate with the first end of the second module and the first module has a greater internal dimension than the external dimension of the second module, such that at least a portion of the second module nests within the first module, and the first and second modules have different structural properties as a result of varying one or more than one property of the filament wound composite material selected from the group consisting of:

(a) angle of winding of the resin infused fibrous reinforcement;
(b) ratio of the fibrous reinforcement to the resin;
(c) wrapping sequence of the resin infused fibrous reinforcement;
(d) wall thickness;
(e) composition of the fibrous reinforcement;
(f) composition of the resin;
(g) composition of additives in the resin; and
(h) a mixture thereof, and wherein the elongated modular pole structure has a desired structural property by selectively combining modules having different structural properties; and wherein the first and second modules have different structural properties selected from the group consisting of flexural strength, compressive strength, resistance to buckling, shear strength, outer shell durability, stiffness and a mixture thereof.

17. The kit as defined in claim 16, wherein the first module has a greater compressive strength than the second module.

18. The kit as defined in claim 16, including a cap configured to mate with the second end of the second module.

19. The kit as defined in claim 16, including a support member configured to mate with the first end of the first module.

20. The kit as defined in claim 19, wherein the support member has an aperture therethrough.

21. The kit as defined in claim 16, wherein the composite material comprises polyurethane composite material.

22. The kit as defined in claim 16, wherein the first and second modules comprise an aliphatic polyurethane composite material top coat.

23. The kit as defined in claim 16, wherein the first module and the second module are dimensioned such that the whole of the second module nests within the first module.

* * * * *